US011143465B2

(12) United States Patent
Manenti

(10) Patent No.: US 11,143,465 B2
(45) Date of Patent: Oct. 12, 2021

(54) PROTECTION DEVICE FOR A SHELL-AND-TUBE EQUIPMENT

(71) Applicant: ALFA LAVAL OLMI S.P.A, Suisio (IT)

(72) Inventor: Giovanni Manenti, Castelli Calepio (IT)

(73) Assignee: ALFA LAVAL OLMI S.P.A, Suisio (IT)

( * ) Notice: Subject to any disclaimer, the term of this patent is extended or adjusted under 35 U.S.C. 154(b) by 17 days.

(21) Appl. No.: 16/473,220

(22) PCT Filed: Mar. 7, 2018

(86) PCT No.: PCT/EP2018/055623
§ 371 (c)(1),
(2) Date: Jun. 24, 2019

(87) PCT Pub. No.: WO2018/166868
PCT Pub. Date: Sep. 20, 2018

(65) Prior Publication Data

US 2019/0353433 A1 Nov. 21, 2019

(30) Foreign Application Priority Data

Mar. 14, 2017 (EP) ..... 17425030

(51) Int. Cl.
*F28F 9/18* (2006.01)
*F28D 7/16* (2006.01)
*F28F 19/00* (2006.01)

(52) U.S. Cl.
CPC ..... *F28F 9/182* (2013.01); *F28D 7/16* (2013.01); *F28F 19/002* (2013.01); *F28F 2265/02* (2013.01); *F28F 2265/10* (2013.01)

(58) Field of Classification Search
CPC ..... F28F 9/18; F28F 9/182; F28F 2265/10; F28F 2265/02; F28F 21/08; F28F 19/00;
(Continued)

(56) References Cited

U.S. PATENT DOCUMENTS 1,184,199 A * 5/1916 Morison ..... F28F 9/0212 165/174
3,451,472 A 6/1969 Keck
(Continued)

FOREIGN PATENT DOCUMENTS

CN 101228410 A 7/2008
CN 102967169 A 3/2013
(Continued)

OTHER PUBLICATIONS

Russian Decision to Grant, dated Mar. 5, 2020, for Russian Application No. 2019131760.
(Continued)

*Primary Examiner* — Harry E Arant
(74) *Attorney, Agent, or Firm* — Birch, Stewart, Kolasch & Birch, LLP

(57) ABSTRACT

Shell-and-tube equipment includes a shell that surrounds a plurality of tubes. At least one end of each tube is joined to an inlet tube-sheet provided with respective tube-sheet bores. The inlet tube-sheet is provided with a first side and with a second side. The inlet tube-sheet is connected to each tube of the tube bundle, on its second side, in such a way that each tube does not extend inside the respective tube-sheet bore. The inlet tube-sheet is provided, on at least part of its tube-sheet bores, with respective tubular protection devices. Each tubular protection device is made in the form of a butt, or a piece of tube, that extends from the first side of the inlet tube-sheet at a respective tube-sheet bore.

19 Claims, 5 Drawing Sheets

(58) Field of Classification Search
CPC ..... F28F 19/002; F28D 7/16; F28D 1/05316; B23K 9/0288; B21D 39/06
See application file for complete search history.

(56) References Cited

U.S. PATENT DOCUMENTS

| | | | | |
|---|---|---|---|---|
| 3,707,186 | A | 12/1972 | Zorrilla et al. | |
| 4,071,083 | A * | 1/1978 | Droin | B23K 35/004 165/173 |
| 4,103,738 | A | 8/1978 | Aydelott et al. | |
| 4,369,605 | A | 1/1983 | Opersteny et al. | |
| 4,519,445 | A | 5/1985 | Norris | |
| 4,585,057 | A | 4/1986 | Marburger | |
| 4,785,877 | A | 11/1988 | Shen-Tu | |
| 4,941,512 | A | 7/1990 | McParland | |
| 5,029,637 | A | 7/1991 | Brucher et al. | |
| 5,101,892 | A | 4/1992 | Takeuchi et al. | |
| 5,323,849 | A | 6/1994 | Korczynski, Jr. et al. | |
| 6,779,596 | B2 | 8/2004 | Wanni et al. | |
| 7,252,138 | B2 | 8/2007 | Burkhalter et al. | |
| 2006/0131005 | A1 | 6/2006 | Birk et al. | |
| 2008/0202732 | A1 | 8/2008 | Gillessen et al. | |
| 2015/0086440 | A1 * | 3/2015 | Scheerder | F28F 9/18 422/201 |
| 2016/0288232 | A1 | 10/2016 | Yoo et al. | |

FOREIGN PATENT DOCUMENTS

| | | | | |
|---|---|---|---|---|
| CN | 103196309 | A | 7/2013 | |
| CN | 203464830 | U | 3/2014 | |
| CN | 104271309 | A | 1/2015 | |
| CN | 106168453 | A | 11/2016 | |
| DE | 1 109 724 | B | 6/1961 | |
| DE | 38 42 727 | A1 | 6/1990 | |
| DE | 39 08 277 | A1 | 9/1990 | |
| DE | 10 2005 032118 | A1 | 1/2007 | |
| EP | 0 246 111 | A1 | 11/1987 | |
| EP | 1331465 | A2 * | 7/2003 | F28F 9/182 |
| EP | 1 674 815 | A1 | 6/2006 | |
| EP | 1 331 465 | B1 | 2/2012 | |
| FR | 2 508 156 | A1 | 12/1982 | |
| GB | 1068098 | * | 10/1964 | |
| JP | 2-70868 | U | 5/1990 | |
| JP | 7-30213 | U | 7/1995 | |
| JP | 9-170896 | A | 6/1997 | |
| JP | 2001-133195 | A | 5/2001 | |
| JP | 2011-99614 | A | 5/2011 | |
| JP | 2016-217654 | A | 12/2016 | |
| RU | 2516998 | C2 | 5/2014 | |
| RU | 2568224 | C1 | 11/2015 | |
| SU | 565196 | A1 | 7/1977 | |
| SU | 709298 | A1 | 1/1980 | |
| WO | WO-2008065478 | A1 * | 6/2008 | B23K 9/16 |
| WO | WO 2016/170486 | A1 | 10/2012 | |

OTHER PUBLICATIONS

International Search Report for PCT/EP2018/055623 (PCT/ISA/210) dated May 17, 2018.
Written Opinion of the International Searching Authority for PCT/EP2018/055623 (PCT/ISA/237) dated May 17, 2018.
English Translation of Korean Office Action for Korean Application No. 10-2019-7029530 dated Dec. 1, 2020.
Examination Report for Indian Application No. 201917035082, dated Dec. 15, 2020.
English translation of the Japanese Office Action, dated Aug. 31, 2020, for Japanese Application No. 2019-547997.

* cited by examiner

PROTECTION DEVICE FOR A SHELL-AND-TUBE EQUIPMENT

BACKGROUND OF THE INVENTION

The present invention refers to a protection device for a shell-and-tube equipment and, more specifically, for tube-side inlet tube-sheets of a shell-and-tube equipment, like heat exchangers and reactors, where the tube-to-tube-sheet joint is of a butt-weld type and is made from the tube-sheet bore (also called "internal bore welding" or I. B. W.). The protection device is aimed to protect the tube-sheet bore from turbulence and erosion of fluid flowing on tube-side.

Turbulent fluids at high velocity or of multiphase type can engender damaging phenomena on shell-and-tube equipment. Gases laden of solid particles or liquid bubbles and liquids laden of solid particles or gas bubbles are typical multiphase flows. When fluid turbulence is locally high, the fluid heat transfer coefficient is enhanced and therefore a local overheating or overcooling may occur, leading to higher thermal-mechanical stresses and corrosion in equipment construction parts. When construction materials of the equipment cannot bear impinging or shear action of a high velocity or multiphase flow, erosion arises.

In shell-and-tube equipment, when the tube-side inlet tube-sheet is connected to tubes by a butt-weld joint made from the tube-sheet bore, the tube-sheet bore may be subject to local high turbulence and erosion. The fluid flowing on tube-side enters into the tube-sheet bore and is in direct contact with the bore surfaces since the tube, being connected to the tube-sheet from an internal bore welding, does not protect the tube-sheet bore. As a consequence, if the inlet tube-side fluid entering into the tube-sheet bore is, for instance, at a higher temperature than the shell-side fluid and is characterised by two-phases (gas-solid, liquid-solid, gas-liquid), the fluid can locally damage the tube-sheet bore, due to overheating or erosion. Such a damage is dangerous since it can significantly reduce the design life of the equipment.

A major example where shell-and-tube type heat exchangers can suffer from erosion is represented by the so called "quench" or "transfer-line" exchangers (TLE), installed in steam cracking furnaces for ethylene production. The process gas leaving the furnace is at high temperature, high velocity and laden of hydrocarbon particles. In the inlet section of the TLE, the process gas can have a velocity in a range of 100 m/s to 150 m/s approximately. Accordingly, in such an application, it is essential to adopt a design or a device for protecting the tube-side inlet pressure parts from local overheating and erosion, so to assure operating reliability and long-life service.

Several devices for protecting tube-side inlet tube-sheet and the tube-side inlet portion of tubes of shell-and-tube equipment from erosion are known in the state of the art. Conceptually, these known technical solutions can be split into two major groups, i.e.:

- protection devices fully or partially inserted into the tubes; and
- protection devices attached to the tubes, but not inserted therein.

The protection devices of the first group can be either an erosion resistant protection device or a sacrificial protection device. As a result, no erosion can occur on the portion of tubes protected by the protection device.

For example, document U.S. Pat. No. 7,252,138 describes a heat exchanger having a cladding on the tube-sheet and flow through plugs welded thereon to prevent erosion, extending inside the tubes. Document U.S. Pat. No. 3,707, 186 describes a heat exchanger having a refractory on one side of the tube-sheet and funnel shaped ferrules placed in the end of the tubes, extending inside the tubes. Document U.S. Pat. No. 4,585,057 describes a shell-and-tube heat exchanger having funnel shaped tube extension inlets made of erosion resistant material to protect the tube-sheet, extending inside the tubes.

The above three patent documents are major examples of protecting devices that are fully or partially inserted into the tubes and therefore the internal diameter of the protecting device is not identical to the internal diameter of the tube. This represents a discontinuity between the internal diameter of the device and the internal diameter of the tube, which can be source of local high turbulence and erosion.

The protection devices of the second group are usually manufactured as an extension of tubes and therefore the erosion occurs on such extension. In fact, the fluid at inlet of the device has a local high turbulence, which is smoothed along the device before reaching the tube. Such extensions can be replaced or repaired.

For example, document FR 2508156 describes how the inlet ends of tubes of a shell-and-tube heat exchanger are protected from erosion by providing them with extension tubes, which can be welded to tubes or expanded against tubes. Document DE 1109724 describes a shell-and-tube heat exchanger having attached to tubes replaceable tubular extensions to prevent erosion. Document U.S. Pat. No. 6,779,596 describes a tubular heat exchanger having sacrificial extended tube lengths allowing for periodic replacement the sacrificial sections that may be cut-off and a new sacrificial section may be welded on. Document U.S. Pat. No. 4,103,738 describes a tubular heat exchanger with replaceable inlet means in shape of tubular extensions with the same diameter as the heat exchanger tubes. The extensions may have bevelled ends. Document U.S. Pat. No. 4,785,877 describes a transfer-line heat exchanger (i.e. a shell-and-tube heat exchanger for a specific service) having hollow truncated cones which are an extension of tubes.

The above five patent documents are major examples of protecting devices that are connected to the tubes, or are integral with tubes. These documents refer to a shell-and-tube heat exchanger where the tubes are not connected by an internal bore welding to the tube-sheet. On the contrary, the tubes go inside the tube-sheet bore either till to the tube-side face of the tube-sheet or beyond the tube-side face of the tube-sheet. Accordingly, the tube-sheet bore is protected by the tube itself, and the protection device is not claimed to protect the tube-sheet bore, but the first portion of the tube.

Additionally, document EP 1331465 of the same Applicant discloses a TLE exchanger of shell-and-tube type wherein the tube-side inlet tube-sheet and the exchanging tubes are welded together by a butt-weld type welding, which eliminates discontinuities and steps in the transition from tube-sheet to tubes. Therefore, there are no obstacles along the gas path that can cause impinging or erosion. On gas-side face, the tube-sheet is protected by a lining (weld overlay) of high-resistant erosion material, which is able to withstand the impinging and shear action of hot gases exiting from the steam cracking furnace. Such a technical solution, which is shown in FIG. 2, has so far been considered to be satisfactory in protecting the gas-side face of the tube-sheet.

However, erosion phenomena may also occur on the internal walls of the tube-sheet bore and on the first portion of the exchanging tubes. Such an erosion on the internal walls of the tube-sheet bore and on the first portion of the exchanging tubes is due to gas turbulence, along with high metal operating temperatures. Entrance of the tube-sheet bores represents a strong discontinuity for the gas path and therefore the tube-sheet bores are a source of turbulence. Downstream of the entrance, the gas flow is chaotic, not well developed from hydrodynamic standpoint. As a consequence, shear and impinging action of gas and hydrocarbon particles on bore and tube walls occurs.

SUMMARY OF THE INVENTION

One object of the present invention is therefore to provide a protection device for a shell-and-tube equipment which is capable of resolving the abovementioned drawbacks of the prior art in a simple, inexpensive and particularly functional manner.

In detail, one object of the present invention is to provide a device for protecting the inlet tube-sheet of a shell-and-tube equipment from erosion and high turbulence due to fluid flowing on tube-side, wherein tubes and tube-sheet are connected by a butt-weld joint made from the tube-sheet bore, and wherein the protection device consists of butts connected to tube-side face of the tube-sheet. Each butt has an off-set from the tube-side face of the tube-sheet and there is no discontinuity between the internal diameter of the butt and the tube-sheet bore diameter at said connection. The protection device according to the present invention is aimed to eliminate, or at least mitigate, the risk of erosion and high local heat transfer coefficient on the surface of the tube-sheet bore, specifically when the inlet tube-side fluid is at high velocity and temperature or with a multiphase flow, like synthesis gases from reforming and gasification processes, effluents from hydrocarbons steam cracking furnaces and slurry type fluids.

This object is achieved according to the present invention by providing a protection device for a shell-and-tube equipment as set forth in the attached claims.

Specifically, this object is achieved by a shell-and-tube equipment comprising a shell that surrounds a tube bundle. The tube bundle comprises a plurality of tubes. At least one end of each tube is joined to an inlet tube-sheet provided with respective tube-sheet bores for inletting a fluid in the shell-and-tube equipment. The inlet tube-sheet is provided with a first side, which receives the fluid, and with a second side, which is opposite to said first side and on which the tubes are joined. The inlet tube-sheet is connected to each tube of the tube bundle, on said second side, in such a way that each tube does not extend inside the respective tube-sheet bore. The inlet tube-sheet is provided, on at least part of said tube-sheet bores, with respective tubular protection devices for protecting said tube-sheet bores from high local turbulence and erosion due to the fluid flowing into said tube-sheet bores. Each tubular protection device is made in the form of a butt, or a piece of tube, that extends from said first side of the inlet tube-sheet at a respective tube-sheet bore, wherein there is no physical contact between the tubular protection devices and the tubes of the shell-and-tube equipment.

Further characteristics of the invention are underlined by the dependent claims, which are an integral part of the present description.

BRIEF DESCRIPTION OF THE DRAWINGS

The characteristics and advantages of a protection device for a shell-and-tube equipment according to the present invention will be clearer from the following exemplifying and non-limiting description, with reference to the enclosed schematic drawings, in which.

DETAILED DESCRIPTION OF THE PREFERRED EMBODIMENT

Figure 1:
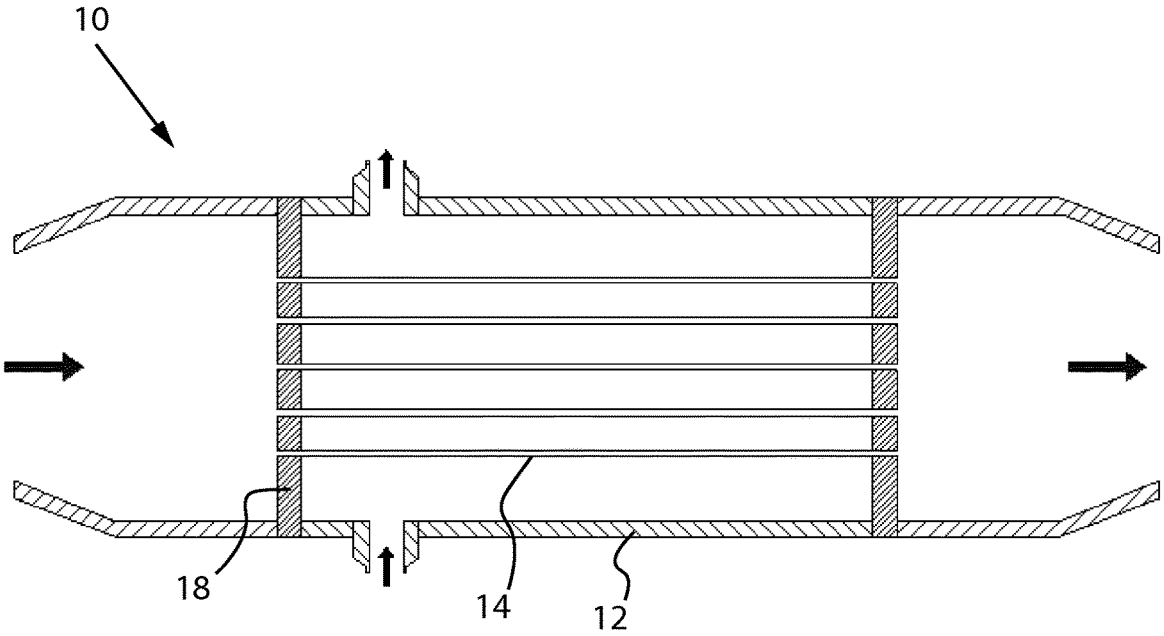
FIG. 1 is a schematic view of a shell-and-tube equipment with horizontally arranged tube bundle.
Figure 2:
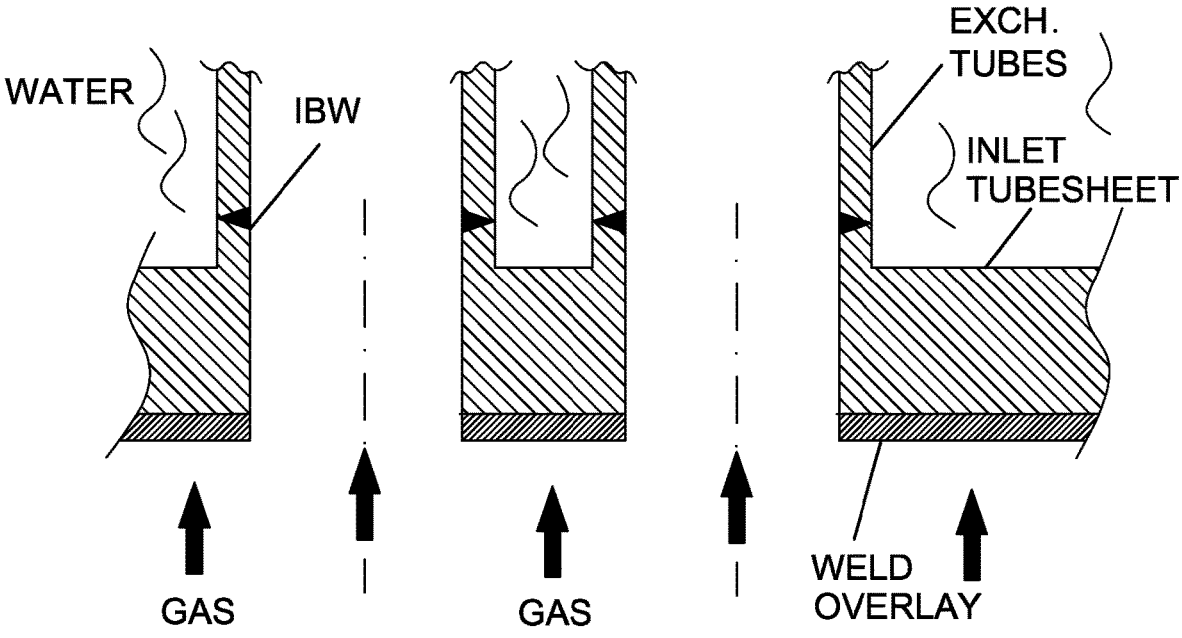
Fig. 2 (PRIOR ART)
FIG. 2 is a partial sectional view of a protection device for a shell-and-tube equipment according to the prior art.

With reference to FIG. 1, a shell-and-tube equipment 10, more specifically a shell-and-tube heat exchanger 10, is shown. The shell-and-tube equipment 10 is of the type comprising a shell 12 that surrounds a tube bundle 14. Although the shell-and-tube equipment 10 is shown in a horizontal orientation, it may also be oriented vertically or at any angle with respect to a horizontal surface.

The tube bundle 14 comprises a plurality of tubes 16. The tubes 16 can be of any shape, like U-shaped or straight. At least one end of each tube 16 is joined to an inlet tube-sheet 18 provided with respective tube-sheet bores 20 for inletting a fluid 22 in the tubes 16 of the shell-and-tube equipment 10.

With reference now to FIGS. 3 to 6, the inlet tube-sheet 18 is provided with a first side 24, or tube-side, which receives the inlet fluid 22, and with a second side 26, or shell-side, which is opposite to said tube-side 24. The fluid 22 is thus introduced into the inlet tube-sheet 18 from the tube-side 24 and is delivered into the tubes 16 laying on the shell-side 26.

On the shell-side 26 the inlet tube-sheet 18 is then connected to each tube 16 of the tube bundle 14, preferably by means of a butt-weld joint 28 made from inside a respective tube-sheet bore 20 of said inlet tube-sheet 18 (this welding technique is also called "internal bore welding" or I. B. W.). Therefore, the butt-weld joint 28 stays on the shell-side 26 of the inlet tube-sheet 18.

According to this butt-weld joint 28, the inlet tube-sheet 18 is provided, on the shell-side 26, with annular protrusions or necks 30 where respective tubes 16 are welded on. In other words, each tube 16 does not extend inside the respective tube-sheet bore 20. As a consequence, each tube-sheet bore 20 is not protected by the respective tube 16 and the fluid flowing on the tube-side 24 of the inlet tube-sheet 18 is in direct contact with the tube-sheet bore 20.

According to the present invention, the inlet tube-sheet 18 is provided, on at least part of its tube-sheet bores 20, i.e. on at least some of the tube-sheet bores 20, with respective tubular protection devices 32 for protecting the tube-sheet bores 20 from high local turbulence and erosion. In particular, the inlet tube-sheet 18 is provided, on the rim of at least part of its tube-sheet bores 20, with respective tubular protection devices 32. More specifically, each tubular protection device 32 is made in the form of a butt, or a piece of tube, that extends from the first side 24, or tube-side, of the inlet tube-sheet 18 at a respective tube-sheet bore 20. In other words, each tubular protection device 32 extends from the opposite side of the inlet tube-sheet 18 with respect to the second side 26, or shell-side, of said inlet tube-sheet 18 where the tubes 16 are joined. Therefore, there is no physical contact between the tubular protection devices 32 and the tubes 16 of the shell-and-tube equipment 10. The tubular protection device 32 does not extend into the tube-sheet bore 20.

Additionally, each tubular protection device 32 has an internal diameter D1, measured at the joining portion 34 between said tubular protection device 32 and the tube-side 24 of the inlet tube-sheet 18, that is substantially identical to the internal diameter D2 of the respective tube-sheet bore 20. Preferably, the internal diameter D1 of each tubular protection device 32 is also substantially identical to the internal diameter D3 of the respective tube 16 placed at the opposite side, i.e. the shell-side 26, of the inlet tube-sheet 18.

Figure 3:
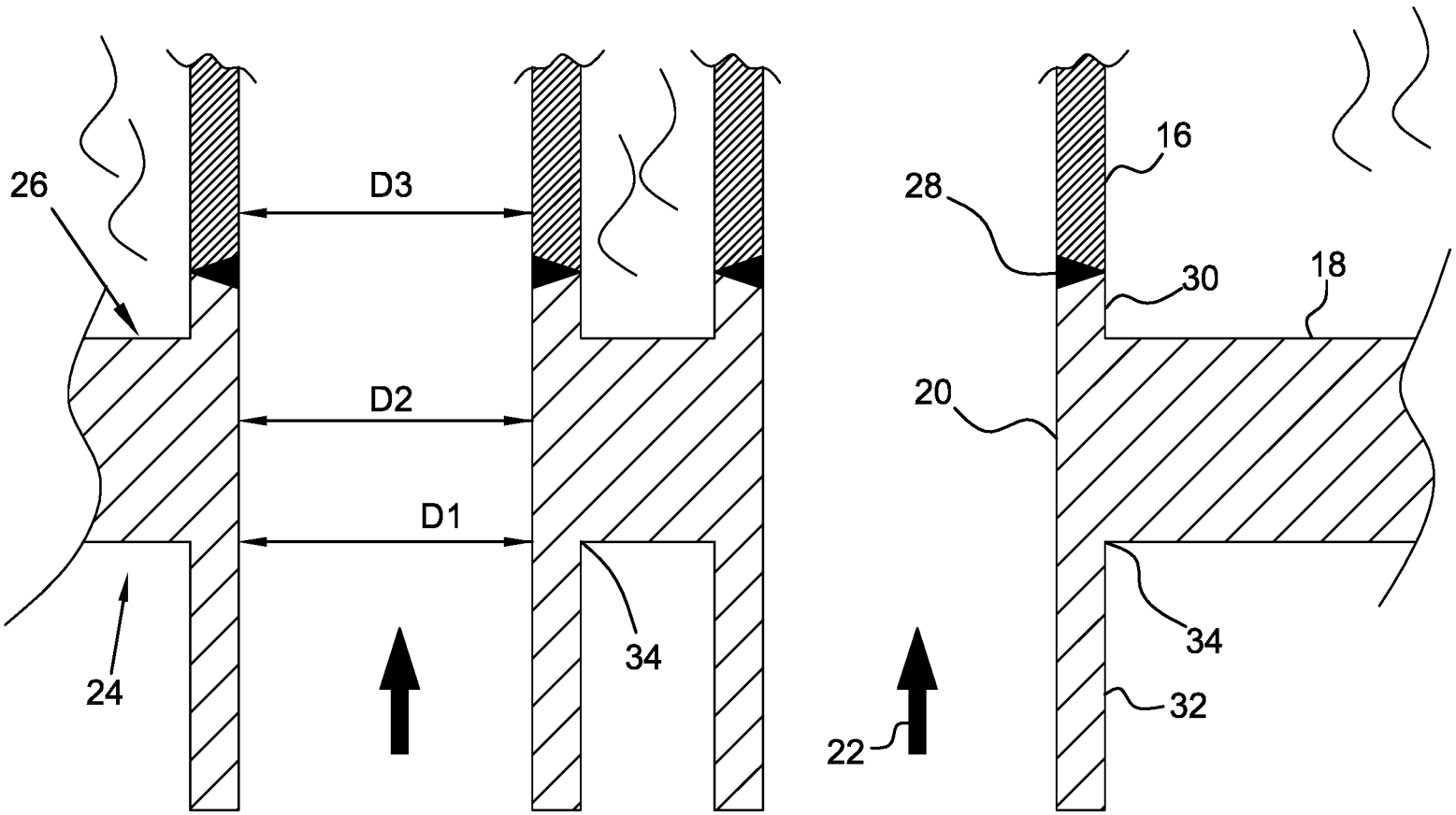
FIG. 3 is a partial sectional view of a first embodiment of a protection device for a shell-and-tube equipment according to the present invention.
Figure 4:
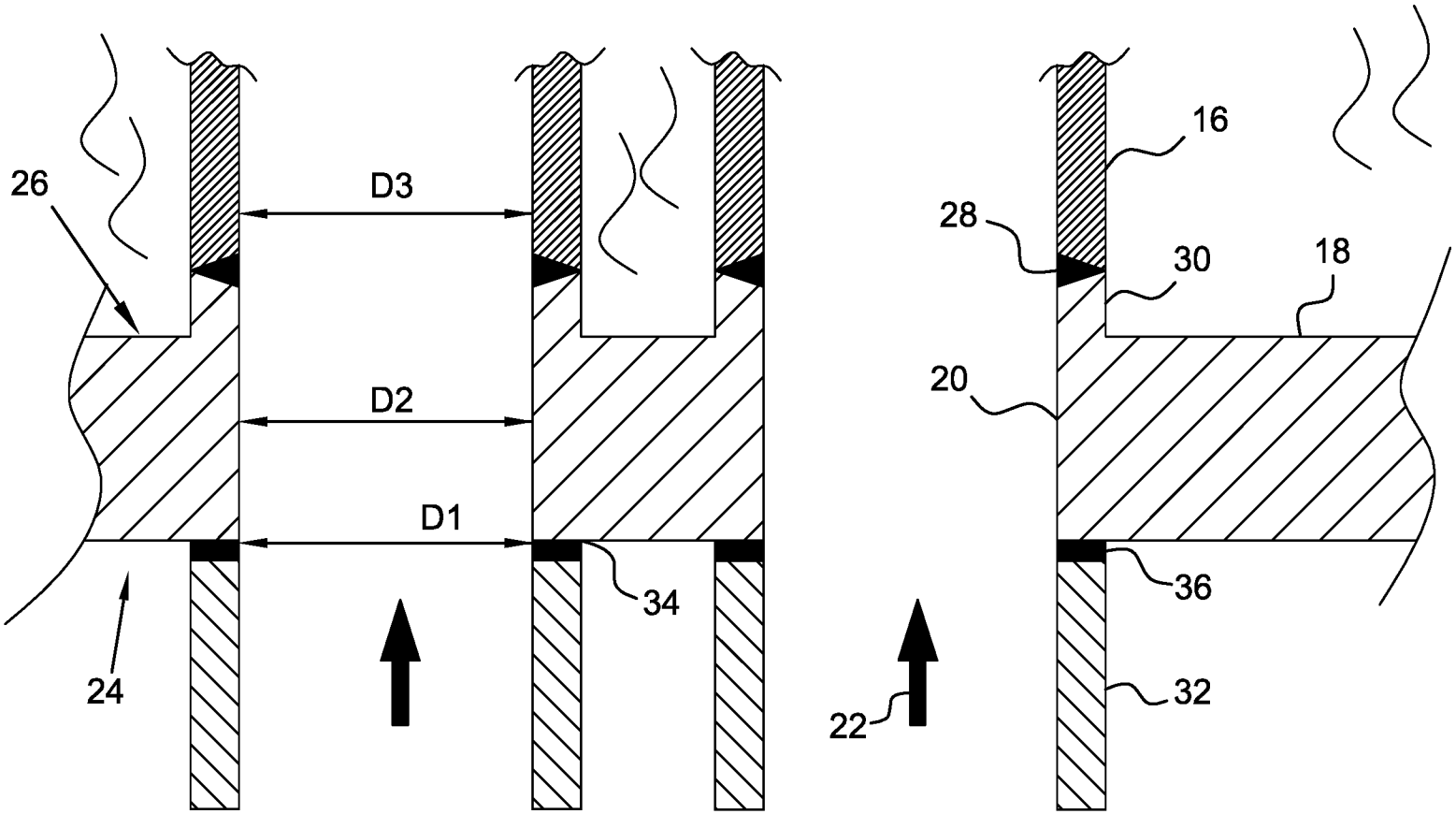
FIG. 4 is a partial sectional view of a second embodiment of a protection device for a shell-and-tube equipment according to the present invention.
Figure 5:
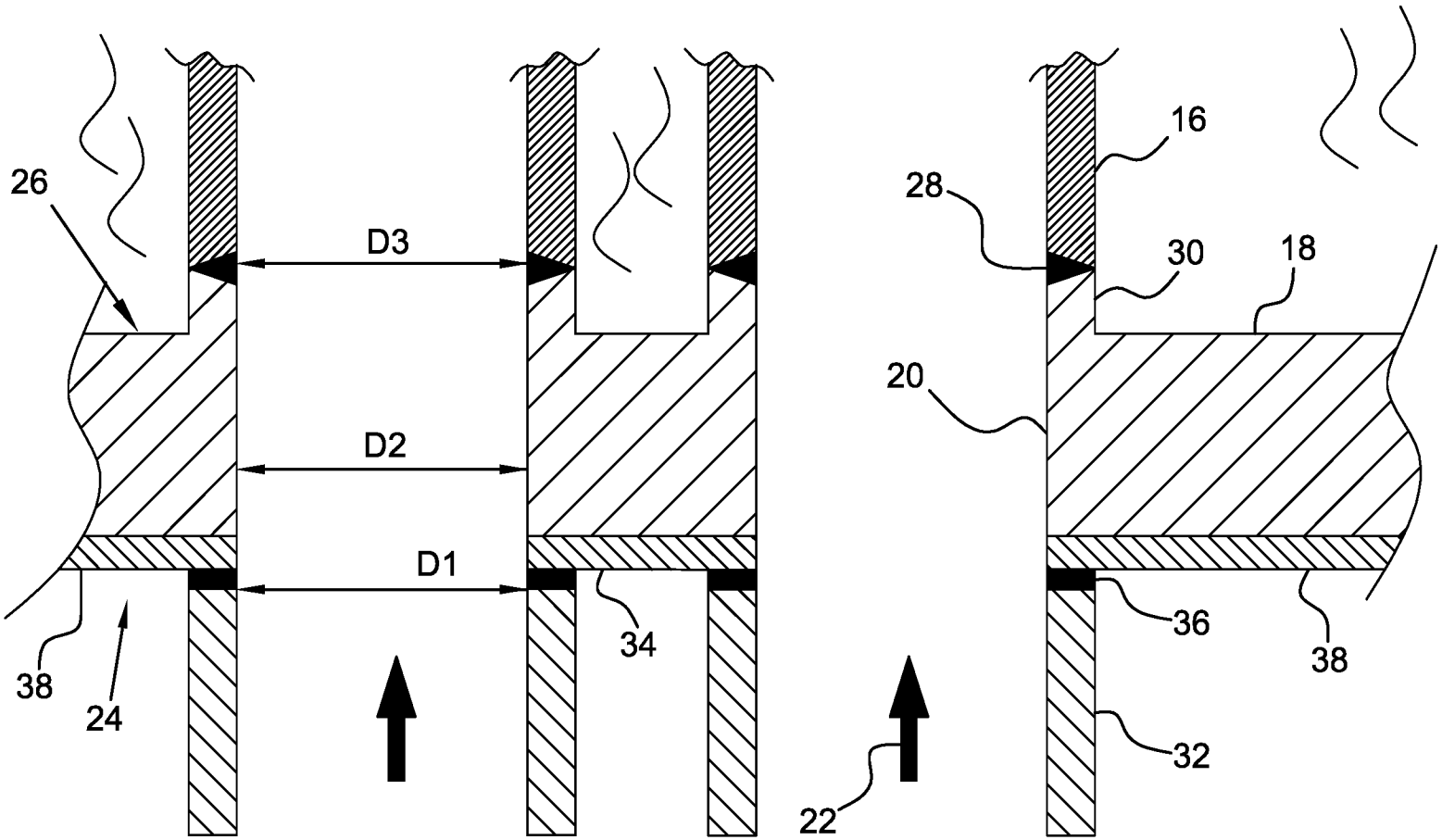
FIG. 5 is a partial sectional view of a third embodiment of a protection device for a shell-and-tube equipment according to the present invention.

According to the preferred but not limiting embodiments shown in FIGS. 3 to 5, each tubular protection device 32 can be connected to the surface of the tube-side 24 of the inlet tube-sheet 18, at the respective joining portion 34, by three alternative ways:

- each tubular protection device 32 is integral with the tube-sheet 18, as shown in FIG. 3, that is, for example, the tubular protection device 32 is made from the tube-sheet 18 by machining;
- each tubular protection device 32 is welded to the tube-sheet 18, as shown in FIG. 4, for example by means of a weld seam 36;
- each tubular protection device 32 is welded to a lining 38 protecting the surface of the tube-side 24 of the inlet tube-sheet 18, as shown in FIG. 5, for example by means of the interposition of a weld seam 36.

In all the connection configurations, each tubular protection device 32 is thus characterized by the following advantageous features:

- it is not in contact with the tubes 16; and
- at the joining portion 34 between the tubular protection device 32 and the tube-side 24 of the inlet tube-sheet 18, the internal diameter D1 of the tubular protection device 32 is substantially identical to the internal diameter D2 of the tube-sheet bore 20, so that there is no discontinuity between the bore of the tubular protection device 32 and the bore 20 of the inlet tube-sheet 18.

As previously mentioned, each tubular protection device 32 has the first purpose to protect the respective tube-sheet bore 20 from high local turbulence and erosion due to the tube-side fluid 22 flowing into said tube-sheet bore 20. Depending on the length of the tubular protection device 32, measured in the tube-side fluid 22 flowing direction, and the thickness of the inlet tube-sheet 18, the tubular protection device 32 can also protect the first tube-side portion of the tubes 16.

As known, a fluid at high velocity entering into a bore from a larger domain increases its velocity and changes its streamlines. This leads to an enhancement of the local turbulence inside the bore. As a result:

- the local heat transfer coefficient increases and, if the tube-side fluid 22 is hotter than the shell-side fluid, a local overheating on the tube-sheet bore 20 can occur; and
- in case of multiphase flow where a phase is abrasive, the abrasive phase can shear or impinge the bore surface, leading to erosion.

The protection of the tube-sheet bore 20 occurs because of the respective tubular protection device 32 suitably regularizes the fluid-dynamics before the tube-side fluid 22 reaches the tube-sheet bore 20. In other words, if local high heat transfer coefficient or erosion occur, they occur on the tubular protection devices 32 and not on the tube-sheet bores 20.

As a result, the tube-sheet bore 20 is not subject, for instance, to dangerous local overheating when the tube-side fluid 22 is the hotter fluid and therefore thermo-mechanical stresses and corrosion phenomena on the inlet tube-sheet 18 are not primed or enhanced. Moreover, the turbulence of the abrasive phase, in case of multiphase flow, is regularized and guided along the longitudinal direction of the tubes axis.

Each tubular protection device 32 can be manufactured either with the same construction material of the inlet tube-sheet 18 (this occurs, for example, in the embodiment of FIG. 3), or from a high erosion resistant material. In all cases, the tubular protection device 32 can be considered as a sacrificial element that can be removed and replaced in case of extended damages.

Figure 6:
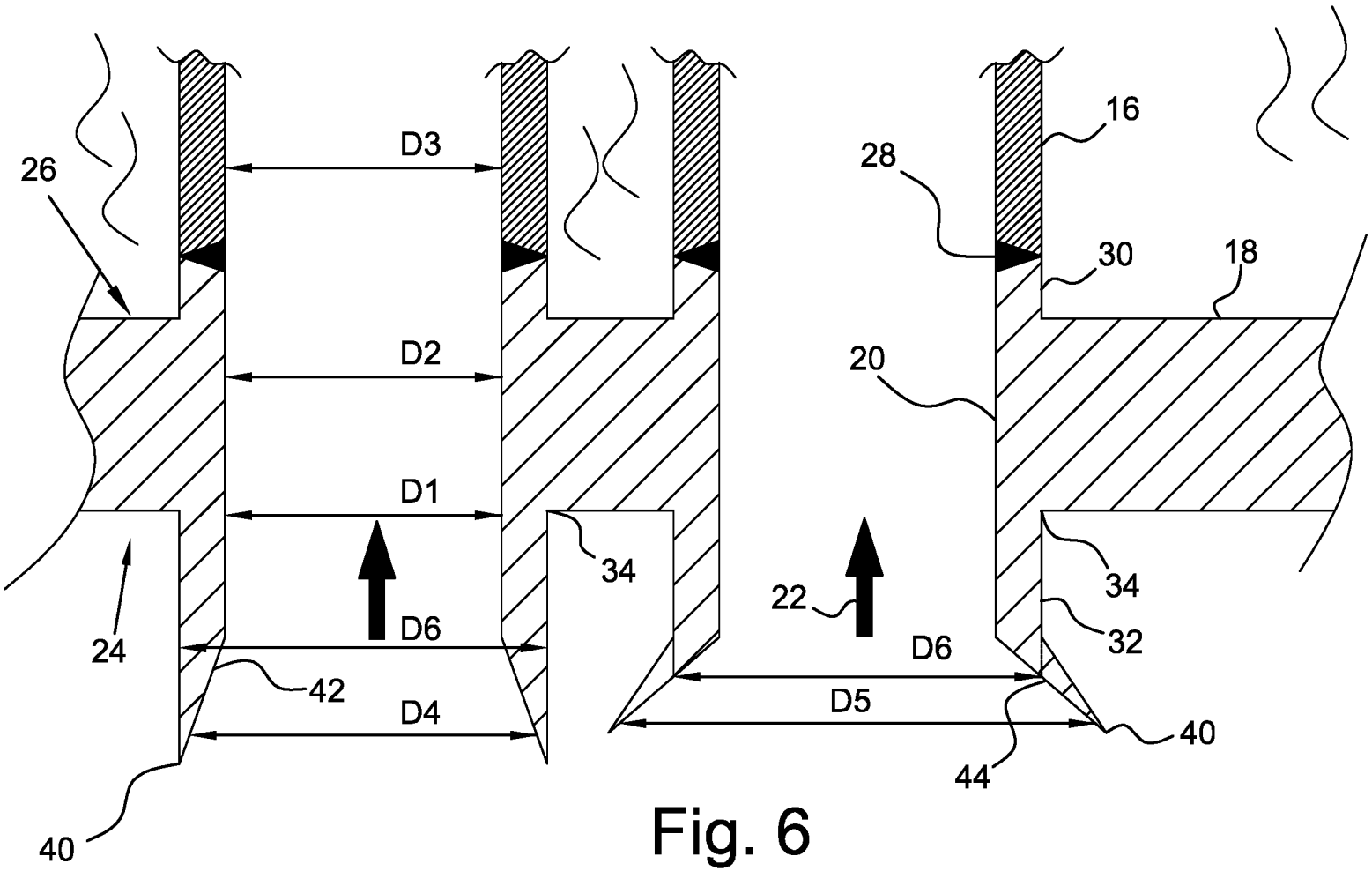
FIG. 6 is a partial sectional view of a fourth embodiment as well as a fifth embodiment of a protection device for a shell-and-tube equipment according to the present invention.

In order to improve the hydrodynamic smoothing action of the tubular protection device 32, the free end 40 of at least part of the tubular protection devices 32, i.e. the end 40 not connected to the joining portion 34 of the inlet tube-sheet 18, can have several shapes. Thus, the free end 40 of at least some of the tubular protection devices 32 can have several shapes. For example, as shown in FIG. 6, the free end of each tubular protection device 32 can have a bevelled shaped portion 42, wherein the internal diameter D4 of said bevelled shaped portion 42, measured at said free end 40, is greater than the internal diameter D1 of the tubular protection device 32, measured at the joining portion 34 between said tubular protection device 32 and the tube-side 24 of the inlet tube-sheet 18. The internal diameter D4 of the bevelled shaped portion 42, measured at the respective free end 40, can also be substantially identical to the external diameter D6 of the respective tubular protection device 32.

Additionally, as once again shown in FIG. 6, the free end 40 of at least part of the tubular protection devices 32, i.e. the free end 40 of at least some of the tubular protection devices 32, can also have a funnel shaped portion 44, wherein the internal diameter D5 of said funnel shaped portion 44, measured at said free end 40, is greater than the internal diameter D4 of the above mentioned bevelled shaped portion 42. The internal diameter D5 of the funnel shaped portion 44, measured at the respective free end 40, can also be greater than the external diameter D6 of the respective tubular protection device 32. In any case, the final smoothing action of the tubular protection device 32 can be set by changing the length of said tubular protection device 32, measured in the tube-side fluid flowing direction, or the entry shape of the respective free end 40.

At least part of the tubular protection devices 32, i.e. at least some of the tubular protection devices 32, can be provided with a disc, such as a circular or square disc, around the free end 40.

The tubular protection device 32 is applicable whenever a shell-and-tube equipment 10 with a tube-to-tube-sheet joint of butt-weld type made from the bore has:

- an inlet tube-side fluid at high velocity which may engender a local high heat transfer coefficient; and
- an inlet tube-side fluid with multiphase flow that may engender erosion.

Some examples of fluids and relevant shell-and-tube equipment 10 that may benefit from the use of the tubular protection device 32 according to the present invention are:

- transfer-line exchangers for effluents from steam cracking furnaces for ethylene production;

process gas boilers and coolers for synthesis gases (reforming, gasification); and reactors for slurry fluids.

The shell-and-tube equipment may thus be a shell-and-tube heat exchanger, in particular a shell-and-tube transfer-line heat exchanger, a shell-and-tube process gas boiler or cooler, or a shell-and-tube reactor, and more particularly a shell-and-tube transfer-line heat exchanger or shell-and-tube process gas boiler or cooler.

It is thus seen that the protection device for a shell-and-tube equipment according to the present invention achieves the previously outlined objects.

The protection device for a shell-and-tube equipment of the present invention thus conceived is susceptible in any case of numerous modifications and variants, all falling within the same inventive concept; in addition, all the details can be substituted by technically equivalent elements. In practice, the materials used, as well as the shapes and size, can be of any type according to the technical requirements.

The protective scope of the invention is therefore defined by the enclosed claims.

The invention claimed is:

1. Shell-and-tube equipment comprising:

a shell that surrounds a tube bundle, wherein said tube bundle comprises a plurality of tubes, wherein at least one end of each of the plurality of tubes is joined to an inlet tube-sheet provided with respective tube-sheet bores for inletting a fluid in the shell-and-tube equipment, wherein the inlet tube-sheet is provided with a first side having a first outer surface of the inlet tube-sheet, which receives the fluid, and with a second side having a second outer surface of the inlet tube-sheet, which is opposite to said first side and on which the tubes are joined, wherein the inlet tube-sheet is connected to each tube of the tube bundle on said second side in such a way that each tube extends outwardly from the second outer surface and does not extend inside the respective tube-sheet bore, wherein the inlet tube-sheet is provided, on at least part of said tube-sheet bores, with respective tubular protection devices extending outwardly from the inlet tube-sheet for protecting said tube-sheet bores from local turbulence and erosion due to the fluid flowing into said tube-sheet bores, wherein each tube-sheet bore extends from the first outer surface to the second outer surface and has a constant internal diameter, wherein each tubular protection device is a tube that extends outwardly from said first outer surface of the inlet tube-sheet at a respective tube-sheet bore and does not extend inside the respective tube-sheet bore, wherein there is no physical contact between the tubular protection devices and the tubes of the shell-and-tube equipment, wherein an inner diameter of the tubes is equal to an inner diameter of the tube-sheet bores and an inner diameter of the tubular protection devices, and wherein a surface of the tube-sheet bores is monolithically formed with the tube-sheet.

2. The shell-and-tube equipment according to claim 1, wherein the internal diameter of each tubular protection device is also substantially identical to an internal diameter of the respective tube placed at the second side of the inlet tube-sheet.

3. The shell-and-tube equipment according to claim 2, wherein the free end of at least part of the tubular protection devices has a bevelled shaped portion, wherein an internal diameter of said bevelled shaped portion, measured at said free end, is greater than said internal diameter of the tubular protection device.

4. The shell-and-tube equipment according to claim 1, wherein the free end of at least part of the tubular protection devices has a bevelled shaped portion, wherein an internal diameter of said bevelled shaped portion, measured at said free end, is greater than said internal diameter of the tubular protection device.

5. The shell-and-tube equipment according to claim 4, wherein the internal diameter of said bevelled shaped portion, measured at said free end, is substantially identical to an external diameter of the respective tubular protection device.

6. The shell-and-tube equipment according to claim 1, wherein the free end of at least part of the tubular protection devices has a funnel shaped portion, and wherein an internal diameter of said funnel shaped portion, measured at said free end, is greater than an internal diameter of a bevelled shaped portion of the tubular protection devices.

7. The shell-and-tube equipment according to claim 6, wherein the internal diameter of said funnel shaped portion, measured at the respective free end, is greater than an external diameter of the respective tubular protection device.

8. The shell-and-tube equipment according to claim 1, wherein each tubular protection device is integral with the inlet tube-sheet.

9. The shell-and-tube equipment according to claim 8, wherein tubular protection device is made from the inlet tube-sheet by machining.

10. The shell-and-tube equipment according to claim 1, wherein each tubular protection device is welded to the inlet tube-sheet.

11. The shell-and-tube equipment according to claim 10, wherein the welding between each tubular protection device and the inlet tube-sheet is obtained by means of a weld seam.

12. The shell-and-tube equipment according to claim 1, wherein each tubular protection device is welded to a lining protecting the surface of said first side of the inlet tube-sheet.

13. The shell-and-tube equipment according to claim 12, wherein the welding between each tubular protection device and said lining is obtained by means of the interposition of a weld seam.

14. The shell-and-tube equipment according to claim 1, wherein the inlet tube-sheet is provided, on said second side, with annular protrusions or necks where respective tubes are welded on.

15. The shell-and-tube equipment according to claim 1, wherein the inlet tube-sheet is connected to each tube of the tube bundle by means of a butt-weld joint made from inside a respective tube-sheet bore of said inlet tube-sheet.

16. The shell-and-tube equipment according to claim 1, wherein each tubular protection device is integral with the inlet tube-sheet.

17. The shell-and-tube equipment according to claim 1, wherein each tubular protection device has a first section having a constant internal diameter.

18. The shell-and-tube equipment according to claim 17, wherein the first section has a first end joined to the inlet tube-sheet and a second end spaced from the first end and a funnel extending outwardly from the second end.

19. The shell-and-tube equipment according to claim 17, wherein each tubular protection device has an internal diameter, measured at the first outer surface of the inlet tube-sheet, that is substantially identical to the internal diameter of the respective tube-sheet bore.

* * * * *